US005310107A

United States Patent [19]

Todd et al.

[11] Patent Number: 5,310,107

[45] Date of Patent: May 10, 1994

[54] PNEUMATIC COMPLIANT TAPE GUIDANCE DEVICE

[75] Inventors: Christian A. Todd, Thornton; Lynn C. Jacobs, Louisville; Brian P. Egan, Thornton, all of Colo.

[73] Assignee: Storage Technology Corporation, Louisville, Colo.

[21] Appl. No.: 977,706

[22] Filed: Nov. 16, 1992

[51] Int. Cl.[5] ..... B65H 20/14

[52] U.S. Cl. ..... 226/196; 226/199; 226/15; 226/19; 242/76

[58] Field of Search ..... 226/196, 197, 97, 15, 226/18, 19, 22, 199; 242/76, 71.9; 384/100

[56] References Cited

U.S. PATENT DOCUMENTS

| | | | |
|---|---|---|---|
| 3,559,859 | 2/1971 | McArthur | 226/19 |
| 4,117,988 | 10/1978 | Moore | 242/71.9 |
| 4,842,177 | 6/1989 | Callender et al. | 226/196 X |
| 4,925,077 | 5/1990 | Daane et al. | 226/97 |

FOREIGN PATENT DOCUMENTS

| | | | |
|---|---|---|---|
| 454584 | 2/1975 | U.S.S.R. | 242/76 |

OTHER PUBLICATIONS

IBM Technical Disclosure Bulletin, "Continuous Compliant Tape Guide", D. E. Griffiths, vol. 15, No. 8, Jan., 1973.

IBM Technical Disclosure Bulletin, "Tape Guide Design", Andresen et al, vol. 27, No. 7B, Dec., 1984.

*Primary Examiner*—Daniel P. Stodola
*Assistant Examiner*—Paul T. Bowen
*Attorney, Agent, or Firm*—Sterne, Kessler, Goldstein & Fox

[57] ABSTRACT

A pneumatic compliant tape guidance device for pneumatically applying a biasing load to a passing tape media. The tape guidance device includes at least one guide button and associated cylinder in which the guide button travels. It also includes a supply port which provides the input for a pressure and/or a vacuum to a pressurized chamber which couples the supply port with the cylinder. The guide button position and its applied pressure are controlled by a compressor which controls the amount of air pressure applied to the guide button through the supply port. The pneumatic compliant tape guidance applies pressure to the top edge or bottom edge of the tape media. The guide button may be configured to travel over a support tube which transfers the pressure/vacuum applied at the supply port to the guide button. The amount of pressure the guide button applies to the passing tape media is determined by the pressure/vacuum which is applied by a pneumatic source to the supply port. The pneumatic compliant tape guidance device enables the present invention to apply a predetermined pressure to the tape media, to change the amount of pressure quickly and easily, and can be used in multiple configurations to apply a specific customized pressure profile to a traveling tape.

18 Claims, 5 Drawing Sheets

PNEUMATIC COMPLIANT TAPE GUIDANCE DEVICE

BACKGROUND OF THE INVENTION

1. Field of the Invention

The present invention relates generally to tape guidance devices and, more particularly, to a pneumatically controlled and compliant tape guidance mechanism.

2. Related Art

Recording data on magnetic tape media requires precise alignment of the media to the read/write head. This alignment is most commonly achieved by mechanically biasing the tape media against a reference edge with some form of spring loaded guides.

One conventional technique which applies the biasing load to the edge of the tape media employs mobile flat springs which contact the edge of the tape. Mobile flat springs are flexible, finger-like extensions which have one end secured in a stationary position and the other end unsecured and extending flexibly from the base.

Referring to FIGS. 1A and 1B, a prior art tape guidance device utilizing such a technique is illustrated. As mentioned above, the device of FIGS. 1A and 1B maintains pressure on the top edge 103 of tape media 102 with a mechanically induced bias, forcing it to maintain contact with reference edge 104 with its bottom edge 105. FIG. 1A illustrates the prior art device without magnetic tape media present. FIG. 1B illustrates the flat spring 106 applying pressure to tape media 102. The tape media 102 travels along what is referred to in the art as an "air bearing." Air bearing 112 supplies a cushion of air along which the tape media 102 travels. This cushion of air causes the tape 102 to travel past the air bearing 112 at a certain distance 101 away from air bearing 112. This distance 101 is referred to as the "tape flying height."

One of the disadvantages with this conventional approach is that the accuracy of the biasing load which is applied to the tape media 102 is determined by the flatness of the steel spring 106. The flatness of the spring controls some of the spring's final tape edge loading. Typically, the tolerance of the spring flatness can be held within 0.005 inches. This in turn causes large variations in the tape edge loading. This also results in less control over the amount of force applied to the tape edge and generates more debris than may be necessary due to the increased wear on the contacting components.

In addition, as shown in FIG. 1B, the flat spring 106 is bent when the tape 102 is present. This results in a non-perpendicular application of force to the top edge 103 of tape 102. As a result, the control over the tape media is reduced, since the load which is applied to the tape is reduced according to the angle at which it is applied. In addition, tape flying height 101 may be altered. It may be unintentionally increased if the guide button 108 pushes the tape media 102 away from the air bearing 112 or the tape flying height may be reduced if the guide button 108 pushes the tape media 102 towards the air bearing 112. In addition, this non-perpendicular force may alternate among multiple guide buttons should more than one be used.

Recently, there has been a great demand for increasing the amount of data which is written to or retrieved from the tape media 102. To satisfy this requirement without changing the size of the tape, the thickness and width of the tapes are reduced so as to increase the amount of tape accumulated on a single reel. However, reduction in the thickness of the tape greatly reduces its strength. In addition, the speed at which the read/write heads are capable of writing and retrieving information has also increased. As a result, control over the bias loading which is applied to the tape to maintain it against its reference edge has become even more critical to prevent damage from occurring to the tape.

These advances have identified additional problems with the conventional techniques: the sensitivity of the guidance device and the inability to adjust the biasing according to the application. For example, when changing the tape media 102 from a standard film (1 mil thick) to thin film (0.5 mil thick), a reduction in tape edge load would reduce tape wear. This cannot be accomplished with the conventional techniques without removing the tape media 102 and changing the flat spring 106 and guide button 108.

Another drawback of the conventional techniques described above is that the guide buttons 108 may roll along the axis of flat spring 106. This also reduces the loading control over the tape guide mechanism. In addition, as the guide buttons 108 'roll' along the axis of the spring, they introduce vibrations into the tape media 102. These vibrations result in shock waves which travel along the length of the tape media 102. Excessive vibrations can result in read and write errors at the read/write head. In addition, flat spring 106 may generate resonant vibrations at certain media speeds. Due to the flexible nature of the flat springs, these vibrations can cause the problems discussed above.

Another conventional tape guidance technique applies the biasing load to the edge of the tape media without the aid of guide button 108. Though this reduces the assembly costs, the steel spring causes more wear to occur to the tape media 102 than the ceramic guide buttons which are used in the above conventional technique. It also does not solve the problem of poor loading control.

What is needed is a tape guide device which can provide accurate tape edge loading. This tape edge loading must be applied at right angles to the media. In addition, the tape guide mechanism must be able to change the biasing load easily to accommodate different types of tape media.

SUMMARY OF THE INVENTION

The present invention is a pneumatic compliant tape guidance device for pneumatically applying a biasing load to the top or bottom edge of a passing tape media. The tape guidance device includes at least one pneumatically-controlled piston or guide button and an associated pneumatic cylinder in which the guide button travels. It also includes a supply port which provides the input for a pressure and/or a vacuum to a pressurized chamber which couples the supply port with the pneumatic cylinders. The guide button position and the pressure it applies to the tape media are controlled by the amount of air pressure or vacuum applied to the guide button. The pressure/vacuum is supplied to the guide button by a compressor via the supply port.

In an alternative embodiment of the present invention, the pneumatic compliant tape guidance device contains a guide button configured with a hollow shaft for a post and an access hole leading into the shaft. This enables the guide button to ride on a support tube which transfers the pressure/vacuum applied at the supply port to the guide button.

The pneumatic compliant tape guidance device enables a predetermined pressure to be applied to the tape media, enables the amount of pressure to be changed quickly and easily, and can be used in multiple configurations to apply a specific customized bias loading profile. In addition the present invention is simple to manufacture and assemble. It also provides uniform button wear since the button may rotate as it guides.

A further advantage of the present invention is that the amount of pressure applied may be the minimal pressure necessary to maintain guidance control. This reduces the wear of the contacting components and in turn reduces the amount of debris which is generated as a result of that contact.

The present invention also absorbs any vibrations which may be generated, thereby preventing shock waves or other harmful effects from occurring.

Further features and advantages of the present invention, as well as the structure and operation of various embodiments of the present invention, are described in detail below with reference to the accompanying drawings. In the drawings, like reference numbers indicate identical or functionally similar elements. Additionally, the left-most digit of a reference number identifies the drawing in which the reference number first appears.

BRIEF DESCRIPTION OF THE DRAWINGS

The present invention will be described with reference to the accompanying drawings, wherein.

DETAILED DESCRIPTION OF THE PREFERRED EMBODIMENTS

Figure 1A:
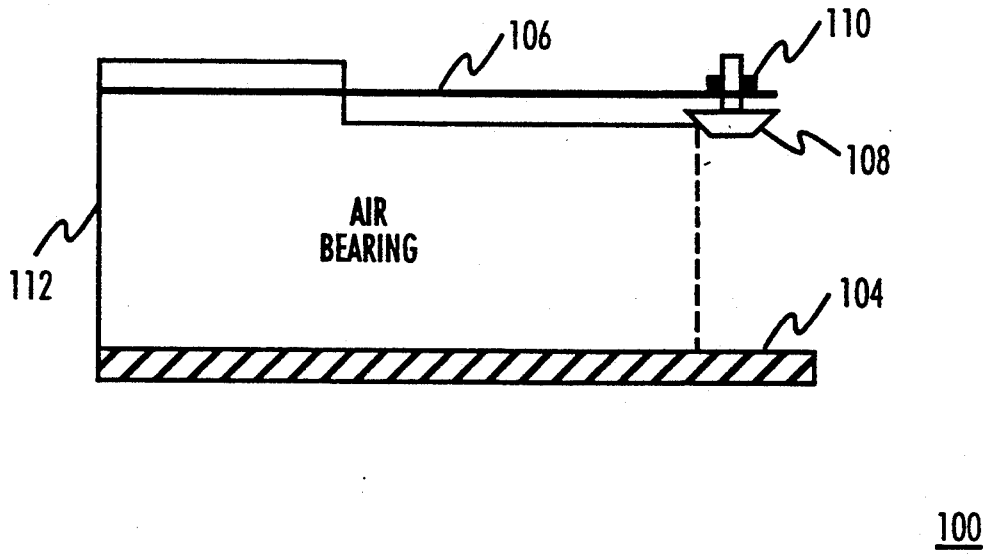
FIG. 1A (PRIOR ART)
FIGS. 1A and 1B illustrate a prior art tape guidance device.
Figure 1B:
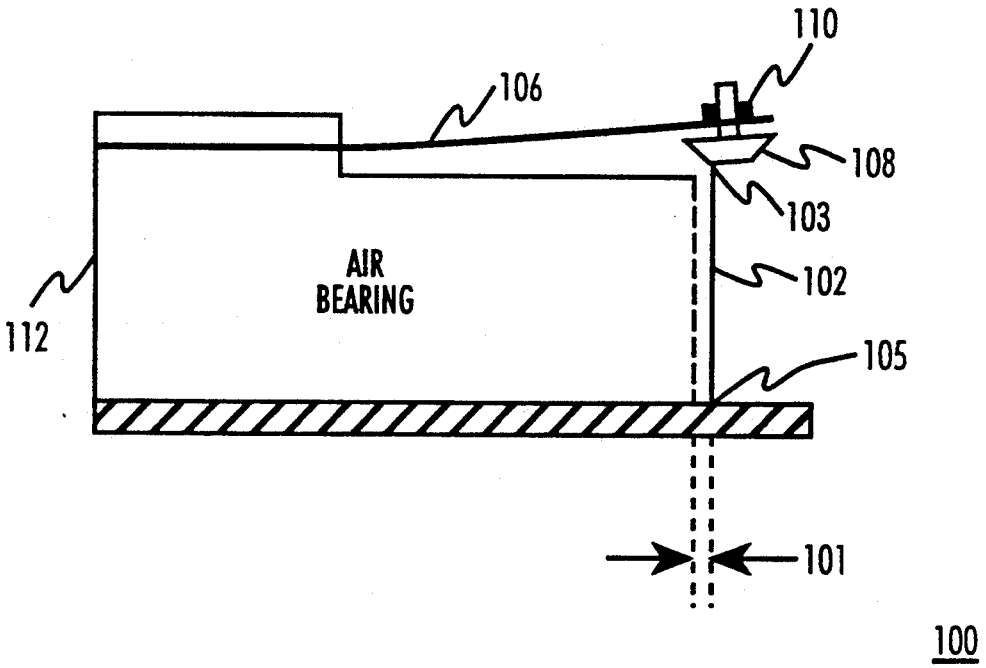
FIG. 1B (PRIOR ART)
Figure 2:
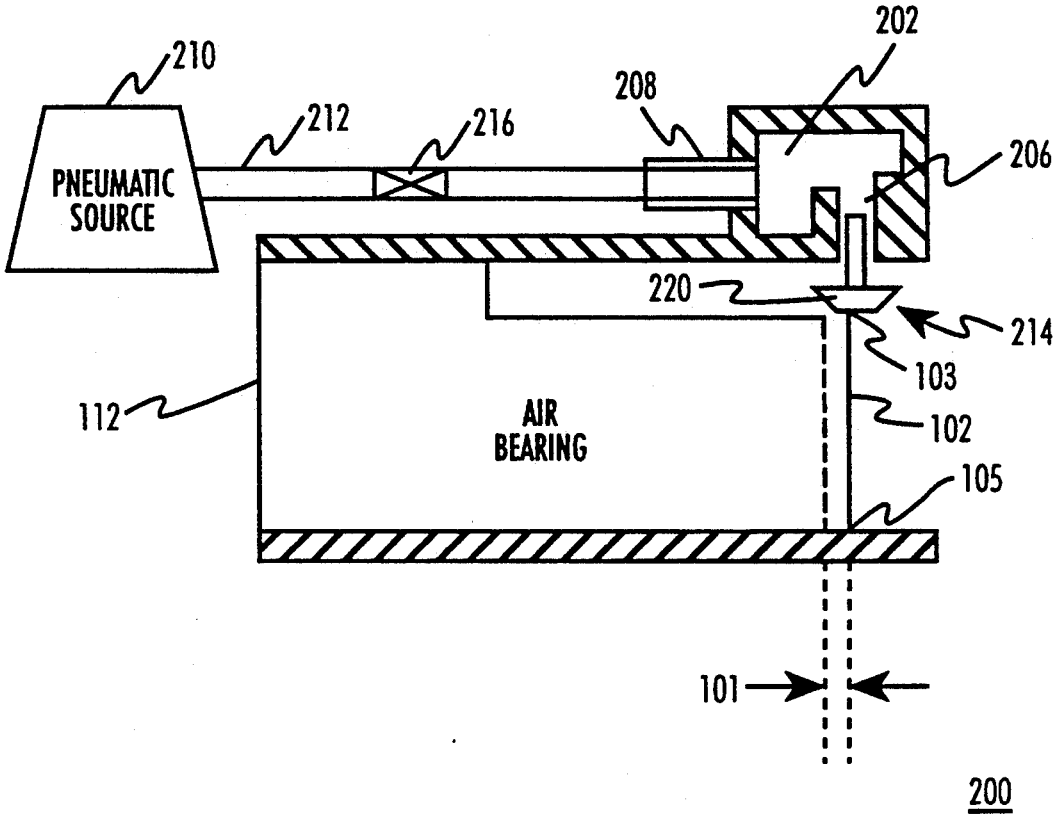
FIG. 2 illustrates a cross-sectional view of a preferred embodiment of the pneumatic compliant tape guidance device 200 of the present invention.

Referring to FIG. 2, a side cross-sectional view of the pneumatic compliant tape guidance device 200 is illustrated. The flat steel string 106 used in the device of FIGS. 1A and 1B is replaced with the pneumatic compliant tape guidance device of the present invention. Pneumatic tape guidance device 200 applies a predetermined load to the top edge 103 of the tape 102 through a guide button 214 installed in cylinder 206. The cylinder 206 is connected to a pressurized chamber 202 which has a supply port 208 for receiving pressure/-vacuum from pneumatic source 210 through supply line 212. The pneumatic source 210 is controlled by the control means 216.

In the preferred embodiment of the present invention, tape media 102 is a magnetic media carrying data. However, one should know that the present invention can be used in any media handling application where edge guiding is required. For example, the present invention can be used in photographic film processing applications as well as paper handling applications. Therefore, hereinafter the references "tape" and "media" should be seen to encompass other materials such as film or paper.

In the preferred embodiment of the present invention, the pneumatic source 210 is a compressor. However, as one of ordinary skill in the art will know, the pneumatic source 210 may take on other forms without changing the scope of the present invention. For example, pneumatic source 210 may be a vane-type air pump. The control means 216 in the present invention is an orifice in line with the supply line 212. However, one should know that control means 216 may be whatever control means necessary to control pneumatic source 210. It may be a simple mechanism which is supplied with the pneumatic source as a single unit. It may also be a more sophisticated device which automatically adjusts the output of pneumatic source 210 as a function of a feedback loop from a sensor placed within pressurized chamber 202. The sophistication of such a control means will be a function of the complexity and sensitivity of the application.

In the embodiment of FIG. 2, the present invention applies a biasing load to the top edge 103 of tape media 102. In this configuration, the guide button 214 applies a force on the tape edge due to the weight of guide button 214 when no pressure or vacuum is supplied by pneumatic source 210. This is extremely small due to the lightweight ceramic materials that a preferably used to make guide button 214. To increase the amount of pressure that guide button 214 applies to the top edge 103 of tape media 102, the pneumatic source 210 must supply a pressure to pressurized chamber 202 which is greater than ambient pressure. Alternatively, should it be desired to remove all pressure from tape 102, the pneumatic source 102 may apply a vacuum to pull away the guide button 206 from the top edge 103 of tape media 102.

Guide button 214 is positioned such that when it is fully extended from cylinder 206, it contacts the top edge of air bearing 112. This is the method employed in the preferred embodiment of the present invention to limit the amount of downward travel of guide button 214 when a pressure is applied by pneumatic source 210. In addition, guide button 214 is configured with a contact head 220 which has a larger diameter than the diameter of cylinder 206. This limits the amount of travel in the upward direction of guide button 214. However, as one of ordinary skill in the art will know, various methods may be used to limit the amount of extension and retraction of guide button 214.

Use of a piston/cylinder approach permits the guide button 214 to rotate freely. This enable the placement of the guide button relative to the top edge 103 to determine the amount of edge wear which will occur. The drag (friction) of the tape edge 103 on the guide button 214 causes the guide button to rotate. The amount of rotation can be controlled by the radial position of the tape edge 103 with respect to the diameter of the guide button 214. In other words, the closer to the center of the guide button 214 that the tape edge 103 is, the less that the guide button 214 will rotate. In the preferred embodiment of the present invention, the guide button 214 has a circular cross-section to rotate as described above. However, one may use a guide button 214 which has a square or oval cross-section to prevent rotation, if desired.

The use of the piston/cylinder controlled by a pneumatic source enables the present invention to absorb any vibrations which may be generated by the guiding function. This prevents the vibrational effects from being transferred to the tape media which may cause read/write errors.

The use of a pneumatic source in the present invention enables the tape edge loading to be controlled in minimal time. By adjusting the amount of pressure/-vacuum supplied by compressor 210 through control means 212, the pressure which guide button 214 applies to the tape media is likewise adjusted. This enables the pneumatic compliant tape guidance device 200 to be immediately adjusted to accommodate the type of tape in a specific application. In addition, the optimal tape edge loading may be more easily obtained in the present invention by adjusting the amount of pressure/vacuum which is applied and measuring or observing the results.

The use of a pneumatic source of control enables very accurate control to be applied to the tape edge. This increases control enabling the tape to be successfully guided with minimal pressure, thereby reducing the amount of wear of the components and the resulting debris generated by such wear.

The pressure which is supplied by pneumatic source 210 is a function of the required pressure to control tape media 102 and the size and mass of guide button 214. For example, if the tape edge loading of a given application is required to be:

Required tape edge loading . . . 0.0066 lbs.

and the chosen guide button 108 has the density, volume and diameter of:

Button density (ceramic) . . . 0.13 lb/cu. in.
Button volume . . . 0.0178 cu. in.
Button post diameter . . . 0.070 in.

the amount of pressure/vacuum which must be used is easily calculated as shown:

| | |
|---|---|
| Button mass | = Button density × Button volume |
| | = .13 lb/cu. in. × .0178 cu. in. |
| | = .0023 lb |
| Post area | = $\pi r^2$ |
| | = 3.1416 (Button radius)$^2$ |
| | = 3.1416 × (.035 in. × .035 in.) |
| | = 3.1416 × .0012 sq. in. |
| | = .0038 sq. in. |
| Force | = Pressure × Area, solving for pressure, |
| Pressure | = Force / Area |
| | = (Tape edge load − Button mass) / Post area |
| | = (0.0066 lb − .0023 lb) / .0038 sq. in. |
| | = .0043 lb / .0038 sq. in. |
| | = 1.13 lb sq. in. |
| | = 1.13 psi |

Thus, 1.13 psi pressure is required to apply 0.0066 lbs load to the top edge of tape media 102 with a guide button 214 having the characteristics above.

Therefore, by selecting a guide button 214 with a known diameter and mass the tape edge loading is simply controlled by varying the supplied pressure/-vacuum.

Figure 3:
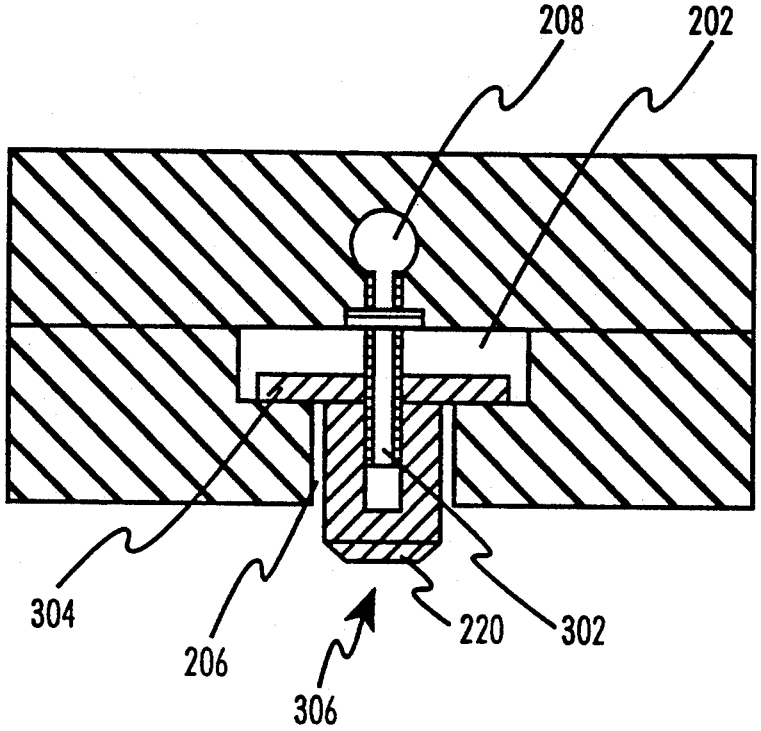
FIG. 3 is a side cross section view of an alternative preferred embodiment of the pneumatic compliant tape guidance device 200.

Referring to FIG. 3, a front cross-sectional view of an alternative embodiment of the present invention is illustrated. The guide button 306 in the configuration of FIG. 3 is comprised of a base 304 which has a wider diameter than the diameter of cylinder 206. This is the method employed in this alternative embodiment of the present invention to limit the downward travel of guide button 306.

If the configuration shown in FIG. 3 is used to guide tape 102 from bottom edge 105, there may not be a need to have the pneumatic source 210 supply a vacuum to the present invention. This is because the pressure that the guide button 306 applies to the bottom edge 105 of tape media 102 may be reduced simply by removing the pressure applied to guide button 306. The weight of guide button 306 will then cause it to fall back into the cylinder 106 when the applied pressure is insufficient to support it.

In the alternative preferred embodiment illustrated in FIG. 3, the guide button 306 rides on top of support tube 302. Support tube 302 not only supports the guide button 306, but also transfers the pressure and vacuum which is supplied by pneumatic source 210 to the guide button 306. In the preferred embodiment of the present invention, support tube 302 is a hypodermic tube. However, one should know that any tube which has the required small diameter and a smooth finish may be used.

As one of ordinary skill in the art would know, the present invention may be used to guide tape 102 by applying pressure to the top edge 103 or bottom edge 105. If used for the latter, the pressure which must be supplied by pneumatic source 210 is different than the pressure calculated above. Specifically, the mass of the guide button 306 must be added from the pressure calculation since the applied pressure must overcome the mass of the guide button. Given the same requirements and button characteristics as above, the pressure will be as follows:

| | |
|---|---|
| Pressure | = Force/Area |
| | = (Tape edge load + Button mass)/Post area |
| | = (.0066 lb + .0023 lb)/.0038 sq. in. |
| | = 2.34 lb/sq. in. |
| | = 2.34 psi |

Therefore, 2.34 psi pressure is required to apply a 0.0066 lbs load to the bottom edge of tape media 102 in this configuration with a guide button 306 having the same characteristics as above. This approach has all the advantages of the preferred embodiment illustrated in FIG. 2 and in addition has a better ratio of guide button shaft diameter to shaft length. This optimum ratio reduces the potential for binding.

Figure 4:
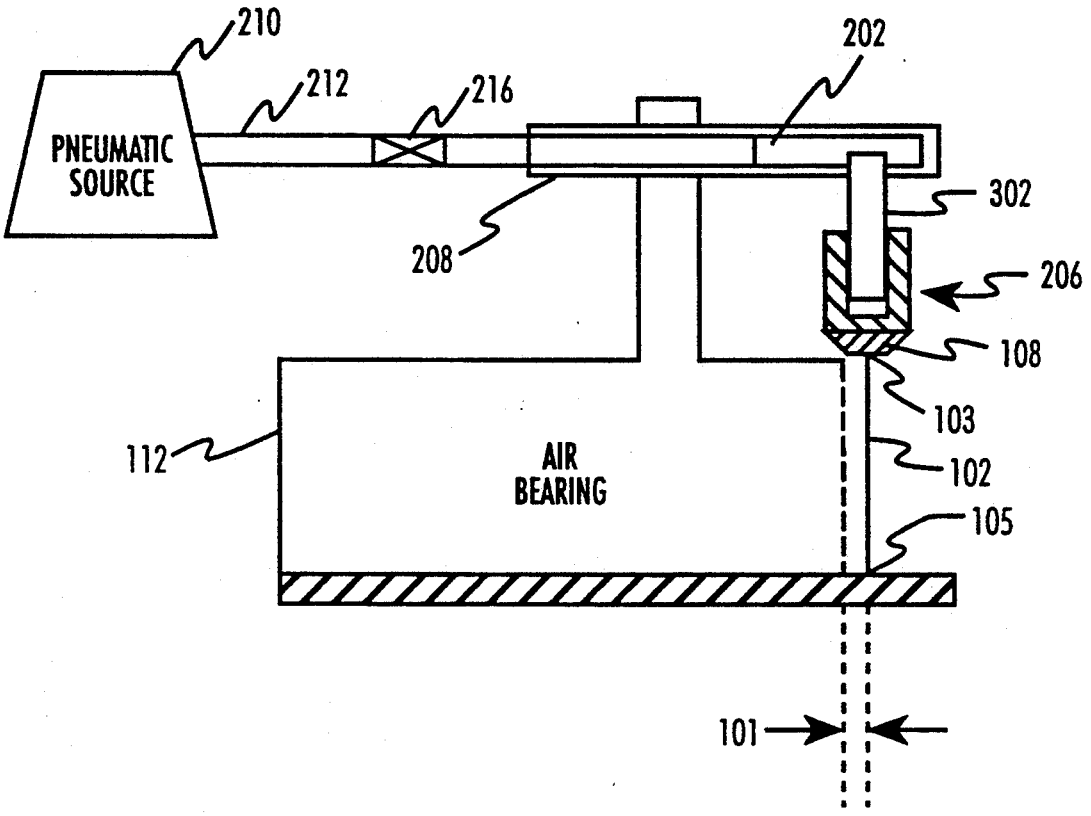
FIG. 4 is a side cross-sectional view of an alternative embodiment of tape guidance device 200.

Referring to FIG. 4, an alternative embodiment of the present invention is illustrated. The pressurized chamber 202 is an extension of supply line 212. In addition, support tube 302, which was used in the alternate preferred embodiment, is used in the pneumatic tape guidance device 400. In this embodiment, cylinder 206 is not present. Rather, guide button 108 travels along support tube 302 which performs the same function as support tube 302 described above.

In a preferred embodiment of the present invention, the guide button 306 is made of a ceramic material due to its high resistance to wear. The mass of the guide button which is used will vary depending on the density of the material chosen and the size and shape of the button. As illustrated in FIGS. 2 and 3, the guide button 306 has a bevel on it in order to facilitate the loading of the tape 102 onto air bearing 112. If the guide button 306 is removed from the path during loading (by applying a vacuum to the pressure chamber), the bevels would not be required. The minimum post area is controlled by the maximum air pressure available and the manufacturing process capabilities of the guide button. For example, it is difficult to make the posts of guide button 102 much smaller than 0.070 diameter with ceramic material. In the preferred embodiment of the present invention, a separate vacuum chamber 202 is utilized. However, one should know that the chamber is not required, and can actually be the supply line 212.

Figure 5:
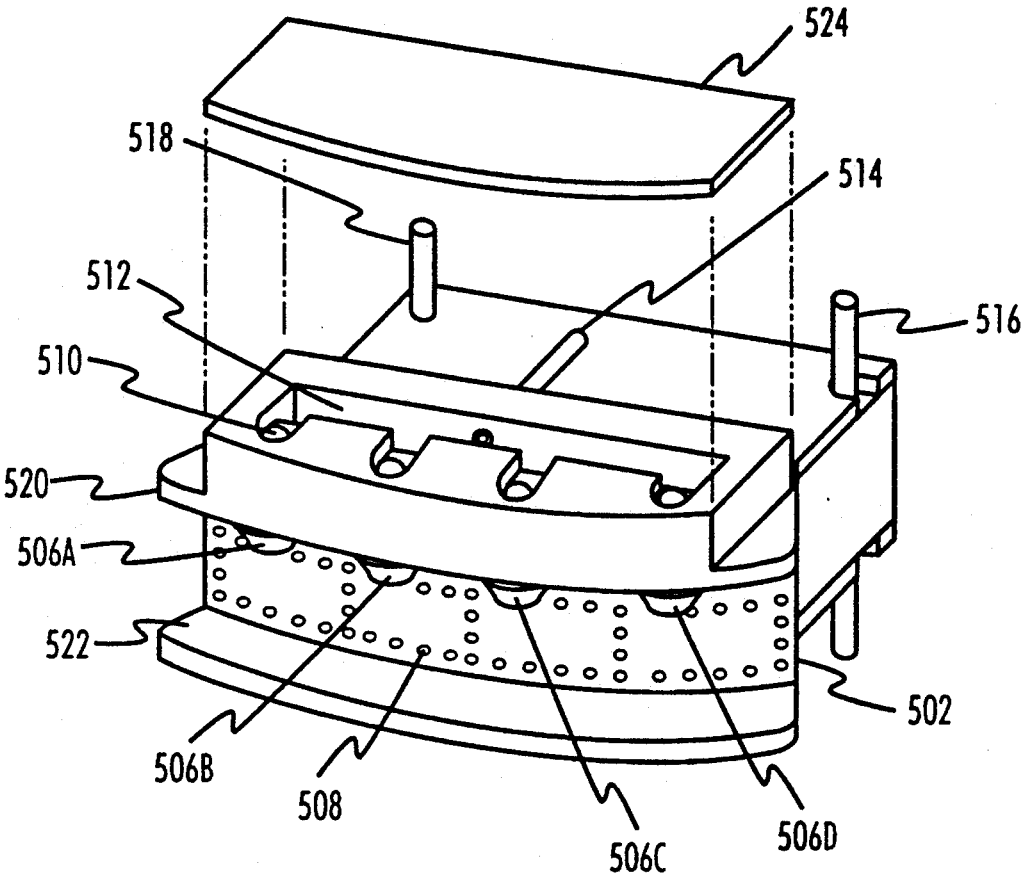
FIG. 5 is a perspective view of an alternative embodiment of the tape guidance device 200 having multiple guide buttons.

In the preferred embodiments of the present invention, multiple guide buttons 214 or 306 are used. FIG. 5 illustrates the preferred embodiment of FIG. 2 utilizing four guide buttons to guide the tape (not shown). Device 500 is comprised of an air bearing 502 from which a steady stream of air is forced through air ports 508 to form a cushion of air on which the tape travels. As described with reference to FIG. 1, air bearing 502 is well known in the art. Device 500 is comprised of two alignment pins 518 and 516. These alignment pins are used to properly align whatever tape guidance means used with the air bearing. The tape guidance means 520 of the present invention has replaced the prior art springs illustrated in FIG. 1. The tape guidance means 520 is comprised of an pressurized chamber 512 and four cylinders 510 coupled to pressurized chamber 512. Supply port 514 is the means used to supply a pressure or vacuum to pressurized chamber 512. The guide buttons 506A through 506D (collectively and generally referred to as 506) are then controlled by the applied pressure/vacuum. The guide buttons 506 apply pressure to the top edge of the tape.

The bottom edge of the tape in turn contacts the reference edge 522, as described above. The four guide buttons 506 form a pressure profile along the length of tape guidance device 520. By controlling each of the multiple guide buttons 506 individually, a variable pressure profile may be developed. Several options are available to customize a pressure profile. For example, one can use constant air pressure and different diameter guide buttons 506 and cylinders 510 or one can use guide buttons 506 which have a different mass. In addition, multiple air pressure sources may be used, each controlling an individual guide button along the air bearing. This approach cannot be used in the configuration illustrated in FIG. 5 since the air pressure/vacuum which is applied to the pressurized chamber 512, is applied to each of the cylinders 510. In order to apply a different pressure/vacuum to each cylinder individually, each cylinder would require a separate means of control. Given these two methods for customizing a pressure profile which varies along the length of the air bearing, one of ordinary skill in the art will know that various combinations of these two approaches may also be used.

While the invention has been particularly shown and described with reference to preferred embodiments thereof, it will be understood by those skilled in the art that various changes in form and detail may be made therein without departing from the spirit and scope of the invention.

What is claimed is:

1. A pneumatic compliant edge guidance apparatus for pneumatically applying a biasing load to a passing tape media, comprising:

guide means for contacting a first edge of the tape media and limiting the movement of the tape media in a first direction, said guide means configured to be pneumatically controlled;

pneumatic means, coupled to said guide means, for pneumatically controlling the biasing load applied by said guide means to said first edge of the tape media; and reference means for contacting a second edge of the tape media opposite said first edge and for limiting the movement of the tape media in a second direction, said second direction being substantially opposite said first direction;

wherein the distance between said guide means and said reference means depends upon the degree of pneumatic control of said guide means by said pneumatic means.

2. The apparatus of claim 1, wherein said guide means comprises:

a pneumatic cylinder;

a pneumatic piston disposed within said pneumatic cylinder; and a supply port coupled to said pneumatic cylinder and said pneumatic means.

3. The apparatus of claim 2, wherein said pneumatic means comprises:

a pneumatic source configured to produce an air pressure in said pneumatic cylinder, said air pressure being selectively variable above and below ambient pressure; and control means for controlling the amount of said air pressure applied to said guide means by said pneumatic source.

4. The apparatus of claim 3 further comprising:

a chamber interposed between said supply port and said pneumatic cylinder.

5. The apparatus of claim 4, further comprising:

limiting means for limiting the distance said pneumatic piston travels in said pneumatic cylinder.

6. The apparatus of claim 1, further comprising:

bearing means for supporting the tape media on a first side of the tape media.

7. The apparatus of claim 6, wherein said bearing means is an air bearing.

8. A pneumatic compliant edge guidance apparatus for pneumatically applying a biasing load to a passing tape media, comprising:

guide means for contacting a first edge of the tape media and limiting the movement of the tape media in a first direction, said guide means configured to be pneumatically controlled, said guide means comprising, a pneumatic piston having a hollow post, a first end which contacts said first edge of the tape media, and a second end which provides access to the interior of said hollow post, a pressure transfer support means having a first end and a second end, said first end of said pressure transfer support means disposed within said hollow post of said pneumatic piston, for supporting said pneumatic piston and for transferring air pressure applied to said second end of said pressure transfer support means through to said first end of said pressure transfer support means, and a supply port coupled to said second end of said pressure transfer support means;

pneumatic means, coupled to said supply port, for pneumatically controlling the position of said pneumatic piston on said pressure transfer support means and for pneumatically controlling the biasing load said first end of said pneumatic piston applies to said first edge of the tape media, said pneumatic means configured to generate and provide an air pressure to said pneumatic piston through said pressure transfer support means; and reference means for contacting a second edge of the tape media opposite said first edge and for limiting the movement of the tape media in a second direction, said second direction substantially opposite to said first direction;

wherein the distance between said first end of said pneumatic piston and said reference means depends upon the distance said pneumatic piston travels on said pressure transfer support means.

9. The apparatus of claim 8, further comprising:

limiting means for limiting the distance said pneumatic piston travels on said pressure transfer support means.

10. The apparatus of claim 9, wherein said pneumatic means comprises:

a pneumatic source, coupled to said guide means, configured to produce an air pressure; and control means for controlling the amount of said air pressure applied to said pneumatic piston by said pneumatic source.

11. The apparatus of claim 10, further comprising:

a pressurized chamber interposed between said supply port and said pressure transfer support means.

12. The apparatus of claim 11, further comprising:

bearing means for supporting the tape media on a first side of the tape media adjacent to said first edge of the tape media.

13. The apparatus of claim 12, wherein said bearing means is an air bearing.

14. A pneumatic compliant tape edge guidance apparatus, comprising:

guide means for contacting a first edge of the magnetic tape to limit the movement of the tape media in a first direction, comprising, a plurality of pneumatic cylinders, and a plurality of pneumatic pistons, each disposed within a respective one of said plurality of said pneumatic cylinders, each of said plurality of pneumatic pistons configured to apply a biasing load to said first edge of the tape, wherein said guide means is configured such that each of said plurality of pneumatic pistons is pneumatically controlled, said biasing loads applied by said plurality of pneumatic pistons together forming a pressure profile along said first edge of the tape;

limiting means for limiting the distance each of said plurality of pneumatic pistons travel in said respective pneumatic cylinder;

at least one supply port coupled to said plurality of pneumatic cylinders; and pneumatic means, coupled to said at least one supply port, for controlling the position of said plurality of pneumatic pistons in said plurality of pneumatic cylinders, and for pneumatically controlling said biasing load applied to said first edge of the tape by said plurality of pneumatic pistons.

15. The apparatus of claim 14, further comprising:

control means for independently controlling the amount of pressure applied to each of said plurality of pneumatic pistons by said pneumatic means.

16. The apparatus of claim 15, further comprising:

reference means for contacting a second edge of the tape to limit movement of the tape in a second direction, said second direction being substantially opposite to said first direction.

17. The apparatus of claim 16, further comprising:

a pressurized chamber interposed between said at least one supply port and said plurality of pneumatic cylinders.

18. The apparatus of claim 17, wherein said plurality of pneumatic pistons are made of ceramic material.

* * * * *

UNITED STATES PATENT AND TRADEMARK OFFICE

CERTIFICATE OF CORRECTION

PATENT NO. : 5,310,107

DATED : May 10, 1994

INVENTOR(S) : Todd et al

It is certified that error appears in the above-indentified patent and that said Letters Patent is hereby corrected as shown below:

On the cover page, item [21] Appl. No. "977,706" with --977,065--.

Signed and Sealed this

Thirtieth Day of August, 1994

*Attest:*

Bruce Lehman

BRUCE LEHMAN

*Attesting Officer*

*Commissioner of Patents and Trademarks*